US006125568A

United States Patent [19]

Granaroli

[11] Patent Number: 6,125,568

[45] Date of Patent: Oct. 3, 2000

[54] FIREARM LOCK

[76] Inventor: George Granaroli, 162 Evergreen Ave., Bethpage, N.Y. 11714

[21] Appl. No.: 09/144,234

[22] Filed: Aug. 31, 1998

[51] Int. Cl.[7] ..... F41A 17/04

[52] U.S. Cl. ..... 42/70.11; 70/315; 70/286

[58] Field of Search ..... 42/70.01, 70.11

[56] References Cited

U.S. PATENT DOCUMENTS

| | | | |
|---|---|---|---|
| 3,637,180 | 1/1972 | Parry | 248/203 |
| 4,014,123 | 3/1977 | Williams | 42/70.11 |
| 4,328,687 | 5/1982 | Ritchie | 70/34 |
| 4,398,366 | 8/1983 | Wernicki | 42/70.11 |
| 4,726,204 | 2/1988 | Peyronnet | 70/315 |
| 4,763,431 | 8/1988 | Allan et al. | 42/70.11 |
| 5,271,174 | 12/1993 | Bentley | 42/70.11 |
| 5,345,798 | 9/1994 | Nakai | 70/284 |
| 5,398,438 | 3/1995 | Williams | 42/70.11 |
| 5,457,907 | 10/1995 | Brooks | 42/70.11 |
| 5,743,039 | 4/1998 | Garrett | 42/70.11 |
| 5,832,647 | 11/1998 | Ling et al. | 42/70.07 |
| 5,930,930 | 8/1999 | Howell | 42/70.11 |
| 5,941,105 | 8/1999 | Macey | 70/225 |

*Primary Examiner*—Charles T. Jordan
*Assistant Examiner*—Denise J Buckley
*Attorney, Agent, or Firm*—Michael I. Kroll

[57] ABSTRACT

The present invention describes a firearm lock 20 having a combination lock 20 for firearms 10 which uses four tumbler locking mechanisms 22, 24, 26 and 28 connected to the firing trigger 16 mechanism by way of a trigger deactuator rod 38. The trigger 16 firing mechanism is disabled until the four or more tumblers 22, 24, 26 and 28 of the combination lock 20 are positioned in such a way as to allow a preselected combination or pin number on the tumblers to communicate with a tumbler pin 44, 46, 48 and 50 attached to the trigger deactuator rod 38. When the numbers of the disk tumblers 22, 24, 26 and 28 are properly entered, the tumbler pins 44, 46, 48 and 50 of the trigger deactuator rod 38 will seat in a single hole and thereby allow the trigger 16 firing mechanism to be actuated. If the wrong number of the combination is entered, the tumbler pin will contact a false hole after traveling only a short distance thereby locking and preventing the trigger mechanism from firing.

10 Claims, 10 Drawing Sheets

FIREARM LOCK

BACKGROUND OF THE INVENTION

1. Field of the Invention

The present invention relates generally to firearm locks and, more particularly, to a firearm lock having a combination lock permanently mounted in the forward section of a firearm trigger assembly whereby the trigger firing mechanism is disabled until a plurality (typically four) or more wheels of the combination lock are properly positioned with the proper preselected combination or pin number.

2. Description of the Prior Art

There are numerous firearm locks designed to prevent unauthorized discharge of firearms. Typical of these firearm locks is U.S. Pat. No. 4,014,123 issued to Williams on Mar. 29, 1977.

Another firearm lock patent was issued to Allan on Aug. 16, 1988 as U.S. Pat. No. 4,763,431. Yet another U.S. Pat. No. 5,271,174 was issued to Bentley on Dec. 21, 1993. Still yet another was issued to Brooks on Oct. 17, 1995 as U.S. Pat. No. 5,457,907.

U.S. Pat. No. 4,014,123

Inventor: Coral C. Williams

Issued: Mar. 29, 1977

A firearm safety device comprising a pair of combination lock type dials mounted concentrically and rotatably on the gun casing. The dial in contact with the casing has an aperture spaced a selected radial distance from the center. The other dial has a pocket spaced the same distance so that they may be aligned together. A plunger is mounted in the casing at the same distance and is spring biased outwardly and axially movable. The inner end of the plunger is extensible into a moving part of the firing mechanism. Aligning the pocket and aperture with the plunger allows it to spring out of engagement with the moving part, therefore releasing the safety, or unlocking the firearm. Sloping grooves adjacent to the pocket and aperture depress the plunger when the dials are rotated.

U.S. Pat. No. 4,763,431

Inventor: Allan et al

Issued: Aug. 16, 1988

Locking devices for guns operate to lock the guns against inadvertent or unauthorized firing, and at the same time enable quick and controlled unlocking of guns, to enable their use, as against home intruders.

U.S. Pat. No. 5,271,174

Inventor: James K. Bentley

Issued: Dec. 21, 1993

A combination wall mount/portable gun lock assembly having a U-shaped locking bar having a pair of laterally spaced leg members. One leg member is inserted into the open end of the gun barrel until it is in the firing chamber. The other leg member has a transversely extending leg portion formed on its end that passes through the trigger guard aperture when the locking bar is installed on the gun. A combination lock is then inserted over the free end of the transversely extending leg portion and pressed tightly against the trigger guard. The locking bar prevents the chambering of a round.

U.S. Pat. No. 5,447,907

Inventor: Frank Brooks

Issued: Oct. 17, 1995

A gun lock assembly includes an engagement portion with a locked position in which a portion of the firing mechanism is operatively engaged to prevent firing of the firearm, and an unlocked position in which operation of the firearm is permitted. The lock preferably includes a lock housing with structure for attaching the lock housing to the firearm. An adapter can be utilized to facilitate attachment of the lock to a variety of different guns. A preferred combination lock is disclosed with structure for altering the combination. An embodiment that is suitable for long arms is also disclosed.

While these firearm locks may be suitable for the purposes for which they were designed, they would not be as suitable for the purposes of the present invention, as hereinafter described.

SUMMARY OF THE INVENTION

The present invention describes a firearm lock having a combination lock for firearms which uses a plurality (typically four) tumbler locking mechanisms connected to the firing trigger mechanism by way of a trigger deactuator rod. The trigger firing mechanism is disabled until the tumblers of the combination lock are positioned in such a way as to allow a preselected combination or pin number on the tumblers to communicate with a tumbler pin attached to the trigger deactuator rod. When the numbers of the disk tumblers are properly entered, the tumbler pins of the trigger deactuator rod will seat in a single hole and thereby allow the trigger firing mechanism to be actuated. If the wrong number of the combination is entered, the tumbler pin will contact a false hole after traveling only a short distance thereby locking and preventing the trigger mechanism from firing.

A primary object of the present invention is to provide a firearm lock for preventing unauthorized discharge of a firearm.

Another object of the present invention is to provide a firearm lock which is a permanent component of the firearm.

Yet another object of the present invention is to provide a firearm lock which does not require the use of a key or other detachable enabling device which may be discovered by children, lost or stolen.

Still yet another object of the present invention is to provide a firearm lock which can quickly and easily be disengaged by the authorized user.

Yet another object of the present invention is to provide a firearm lock with means for changing said combination or pin number at the discretion of the authorized user.

Still yet another object of the present invention is to provide a firearm lock which is adaptable to automatics and revolvers in addition to rifles which include shotguns and automatic weapons of the military type such as "M-16" and "AK-47".

Additional objects of the present invention will appear as the description proceeds.

The present invention overcomes the shortcomings of the prior art by providing a firearm lock which is simple to operate, a permanent component of the firearm, having a combination that is easily changed and prevents unauthorized use, and does not require the use of a key or other enabling device which can be discovered by children, lost or stolen.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

DESCRIPTION OF THE PREFERRED EMBODIMENT(S)

Figure 1:
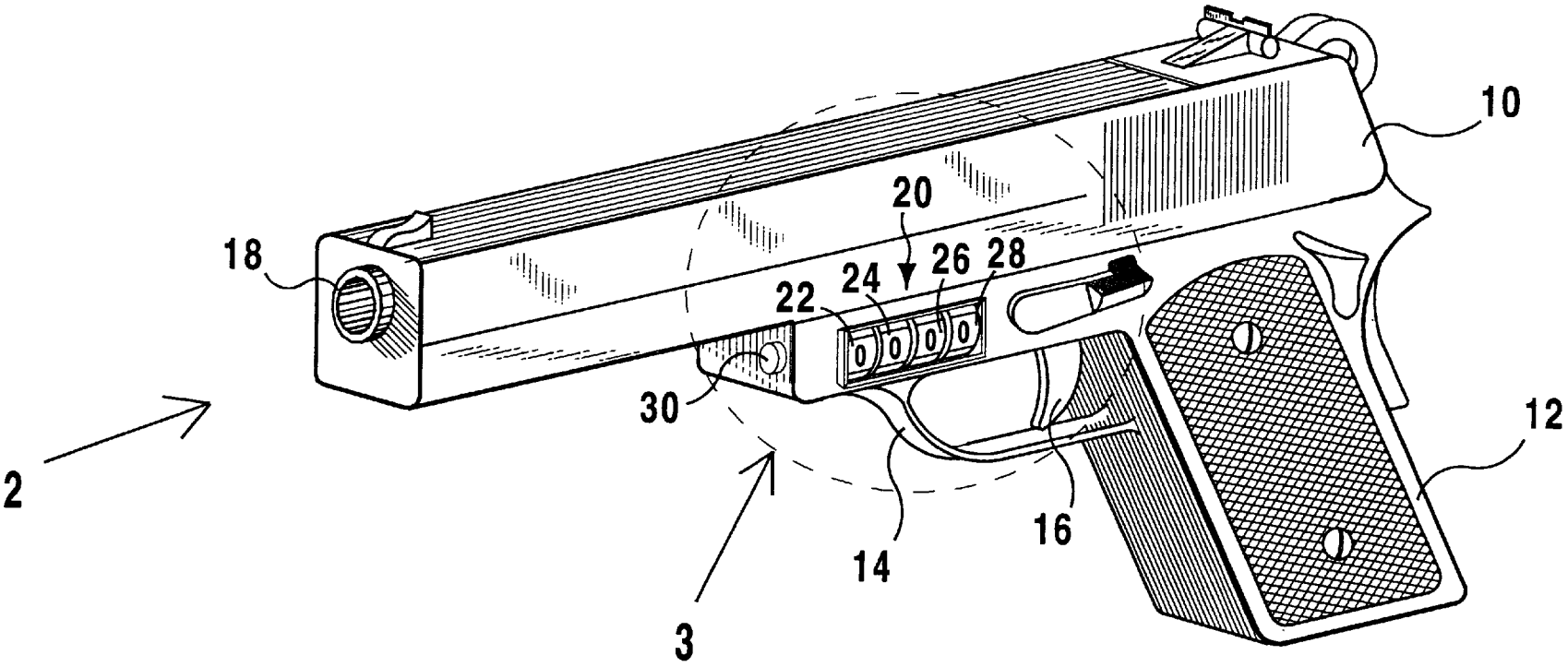
FIG. 1 is a perspective view of the present invention installed in a firearm. Shown is a combination lock having a plurality (typically four) disk tumblers, which provides for 10,000 possible various combinations, incorporated into the stock of a firearm.

Turning now descriptively to the drawings, in which similar reference characters denote similar elements throughout the several views, FIGS. 1 through 10 illustrate the present invention being a device 20 for locking triggers of firearm 10. With regard to the reference numerals used, the following numbering is used throughout the various drawings.

10 firearm, including automatics and revolvers in addition to rifles which include shotguns and automatic weapons of the military type such as "M-16" and "AK-47"
12 handle
14 trigger guard
16 trigger
17 pivot point
18 barrel
20 present invention
22 disk tumbler
24 disk tumbler
26 disk tumbler
28 disk tumbler
30 gear release button
32 center tumbler shaft
34 spring
36 spring
38 trigger deactuator rod
40 front support
42 rear support
44 tumbler pin
46 tumbler pin
48 tumbler pin
50 tumbler pin
52 toothed gear
54 toothed gear
56 toothed gear
58 toothed gear
60 pin holes
62 pin holes
64 pin holes
66 pin holes
68 flange
70 flange
72 flange
74 flange
76 rifle Turning to FIG. 1, therein is shown a perspective view of the present invention 20 installed on a firearm 10. Therein is shown the firearm 10 with handle 12, trigger guard 14, the trigger 16, and the barrel 18. Also shown therein is the combination lock of the present invention generally shown at 20 along with its multiple disk tumblers 22, 24, 26 and 28. Also shown therein is the gear release button 30 for allowing the combination to the disk tumblers to be changed. The disk tumbler combination lock assembly 20 has a plurality (typically four) individual disk tumblers, 22, 24, 26 and 28, which can provide for a possible 10,000 lock combinations, all of which is incorporated into the stock of the firearm 10.

Figure 2:
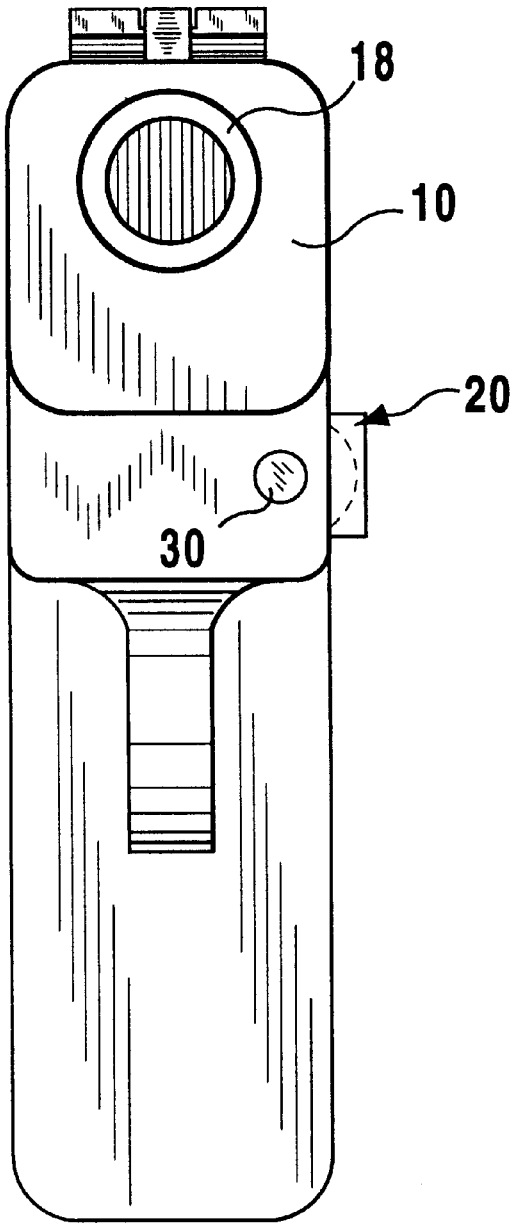
FIG. 2 is a front plan view showing the outline of the disk tumbler padlock and the gear release button for changing the combination.

Turning to FIG. 2, therein is shown a front plan view of a firearm 10 showing the outline of the present invention 20 and the gear release button 30 along with the firearm 10 and the barrel 18. As can be seen, the disk tumbler lock of the present invention 20 is located on the left-hand side of the firearm 10 for easy finger acutuation by the user.

Figure 3:
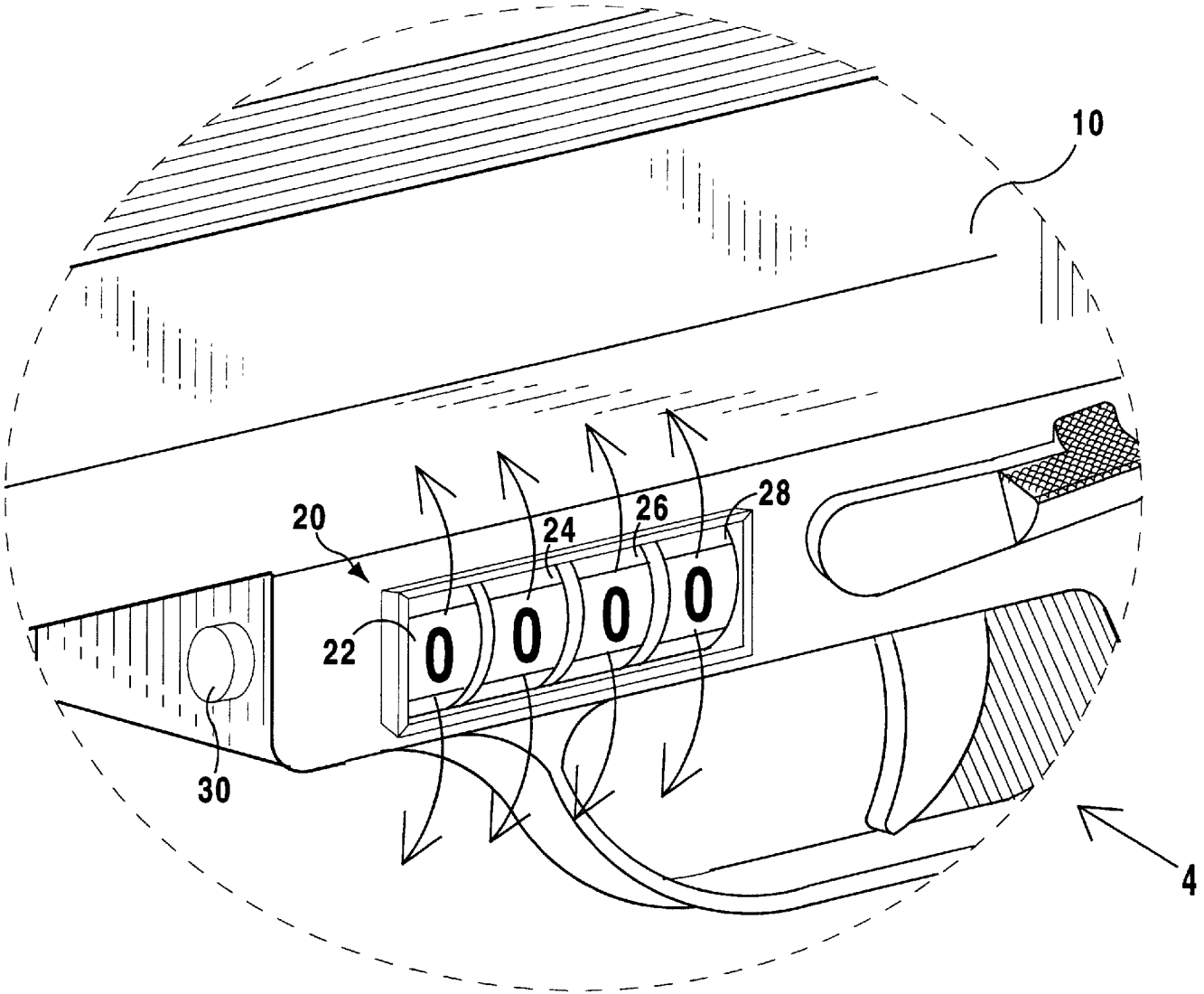
FIG. 3 is an enlarged view of the present invention, taken from FIG. 1 as indicated. Shown is a number of selectable tumblers, also shown is a button whereby the authorized user can change the combination or pin number by entering the correct combination and pushing the button which displaces the center gear allowing rotation of the outer numbered tumblers.

Turning to FIG. 3, therein is shown an enlarged view of the present invention 20 taken from FIG. 1 as indicated. Shown therein is the firearm 10, the selectable tumblers, 22, 24, 26 and 28, along with the gear release button 30 whereby in operation the authorized user can change the combination of the disk tumblers by pushing inwardly on the button 30 which displaces an internal center gear (not shown) allowing rotation of the outer numbered tumblers 22, 24, 26 and 28.

Figure 4:
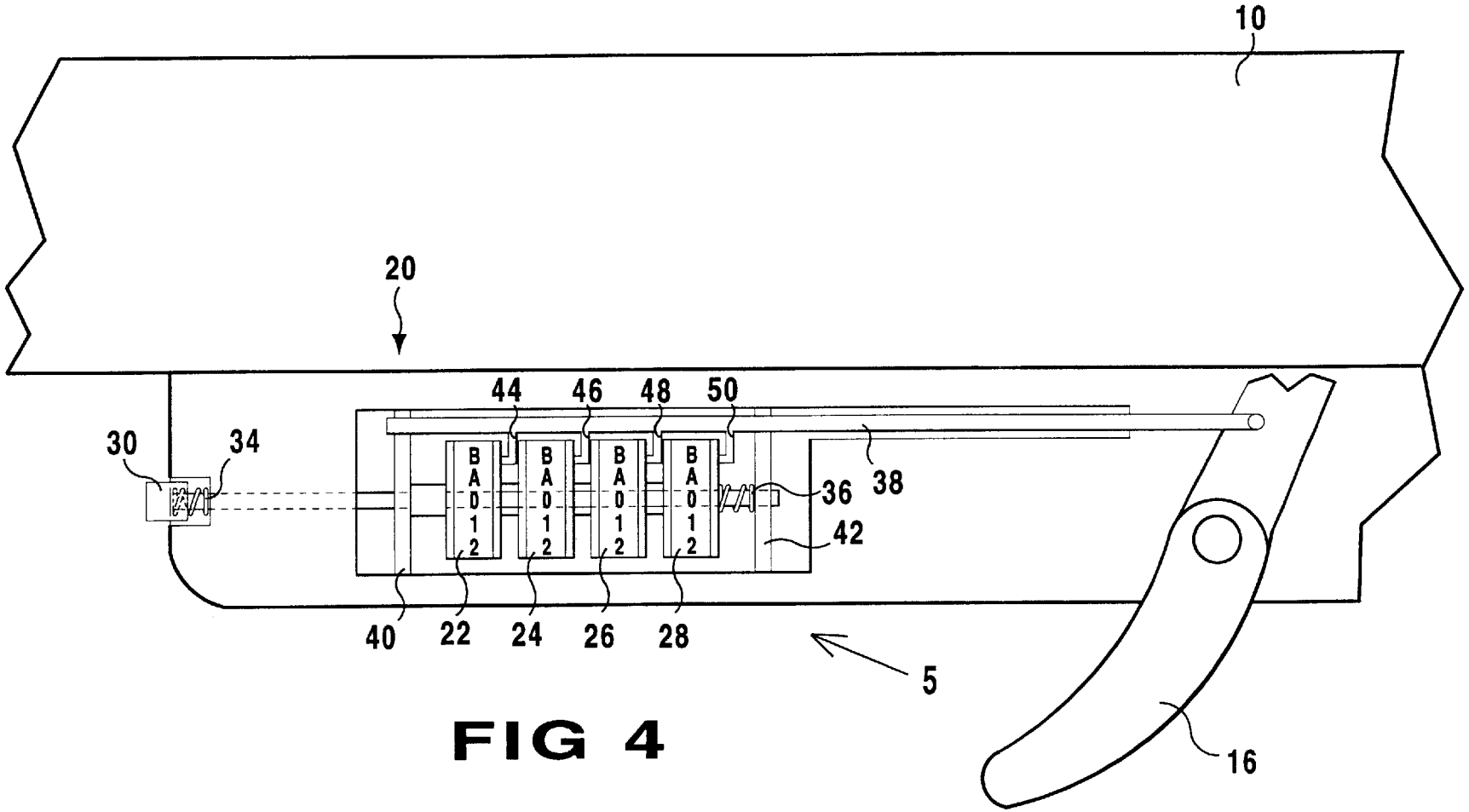
FIG. 4 is a diagrammatic view of the present invention.

Turning to FIG. 4, therein is shown a diagrammatic view of the present invention 20. Shown therein is the trigger 16, the trigger pivot point 17, the push button release 30, mounted on a center tumbler shaft 32, having springs 34 and 36 mounted so as to have the center shaft 32 outwardly biased and axially inwardly movable. Also shown therein is the tumbler lock mechanism 20, the tumblers 22, 24, 26 and 28, and a trigger deactuator rod 38 adjacent to and parallel to the central shaft 32 connected to the trigger 16. The center tumbler shaft 32 and the trigger deactivator rod 38 are mounted on the support means 40 and 42. Note also that the L-shaped tumbler pins 44, 46, 48 and 50 extend transversely from the side of the trigger deactivator rod 38 so as to contact the tumblers 22, 24, 26 and 28.

Figure 5:
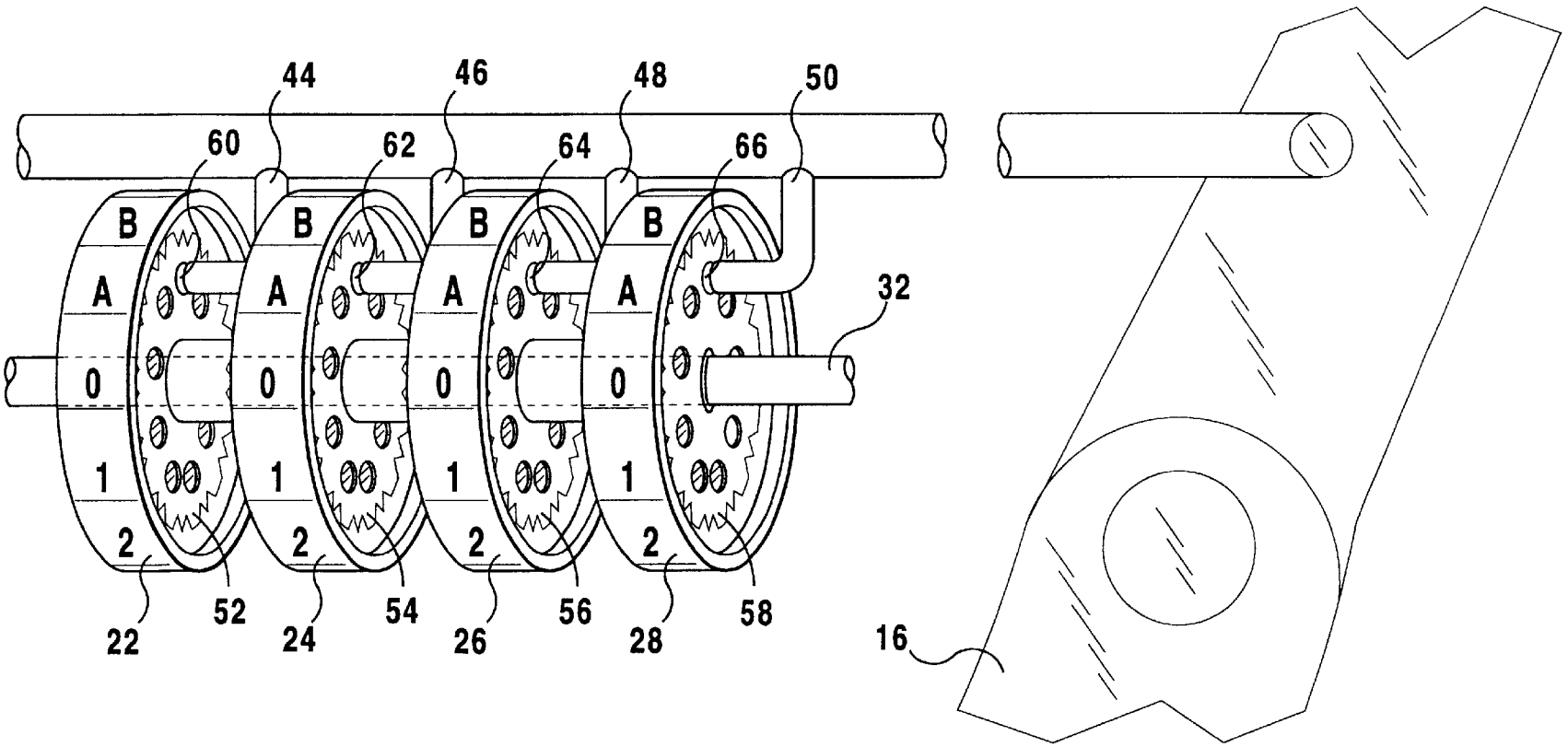
FIG. 5 is a perspective view of the tumblers. Shown is a toothed gear inside each tumbler. When the trigger is depressed the pins advance into a number of holes located on the inner gear. The number of holes corresponds to the number of selections imprinted on each tumbler. If one or more incorrect number or letter is selected the pins will bottom out in the false holes at approximately 1 millimeters. If the correct combination is entered, the pins will enter the single hole for each tumbler that will allow the trigger to be pulled.

Turning to FIG. 5, therein is shown a perspective view of the tumblers of the present invention 10. The tumblers are shown at 22, 24, 26 and 28. Also shown is a toothed gear 52, 54, 56 and 58 concentrically mounted and communicating with and located inside of each tumbler. The tumbler pins, 44, 46, 48 and 50, are aligned with pin holes 60, 62, 64 and 66 which are adjacent to and parallel with the central shaft 32 so that when the trigger 16 is depressed the pins 44, 46, 48 and 50 advance and seat into holes 60, 62, 64 and 66 located on the inner toothed gear 52, 54, 56 and 58 of each tumbler. The number of holes 60, 62, 64 and 66 present on the toothed gear 52, 54, 56 and 58 corresponds to the number of available selections numerically or alphabetically imprinted and circumferentially spaced on each tumbler 22, 24, 26 and 28. When the trigger 16 is depressed, the pins 44, 46, 48 and 50 which are attached to the trigger deactivation rod 38 forwardly advance into the hole 60, 62, 64 and 66 corresponding to the number of the selection on the tumbler 22, 24, 26 and 28. If one or more incorrect number or letter on the tumbler is selected the pins 44, 46, 48 and 50 bottom out on one of the shallow or false holes of the toothed gear 52, 54, 56 and 58 created by the incorrect selection at approximately one millimeter thereby preventing further depression of the trigger 16 and likewise locks and prevents rotation of the tumblers and provides trigger deactivation means. If the correct combination is entered, the pins 44, 46, 48 and 50 communicate with and enter the single true and complete hole in the toothed gear for each tumbler mechanism that will allow the trigger to be fully pulled and thereby fire the weapon. The tumblers 22, 24, 26 and 28 each displays the digits 0–9 along with the alphabetical letters A and B which dictates that there be eleven shallow holes and one complete or true hole.

Figure 6:
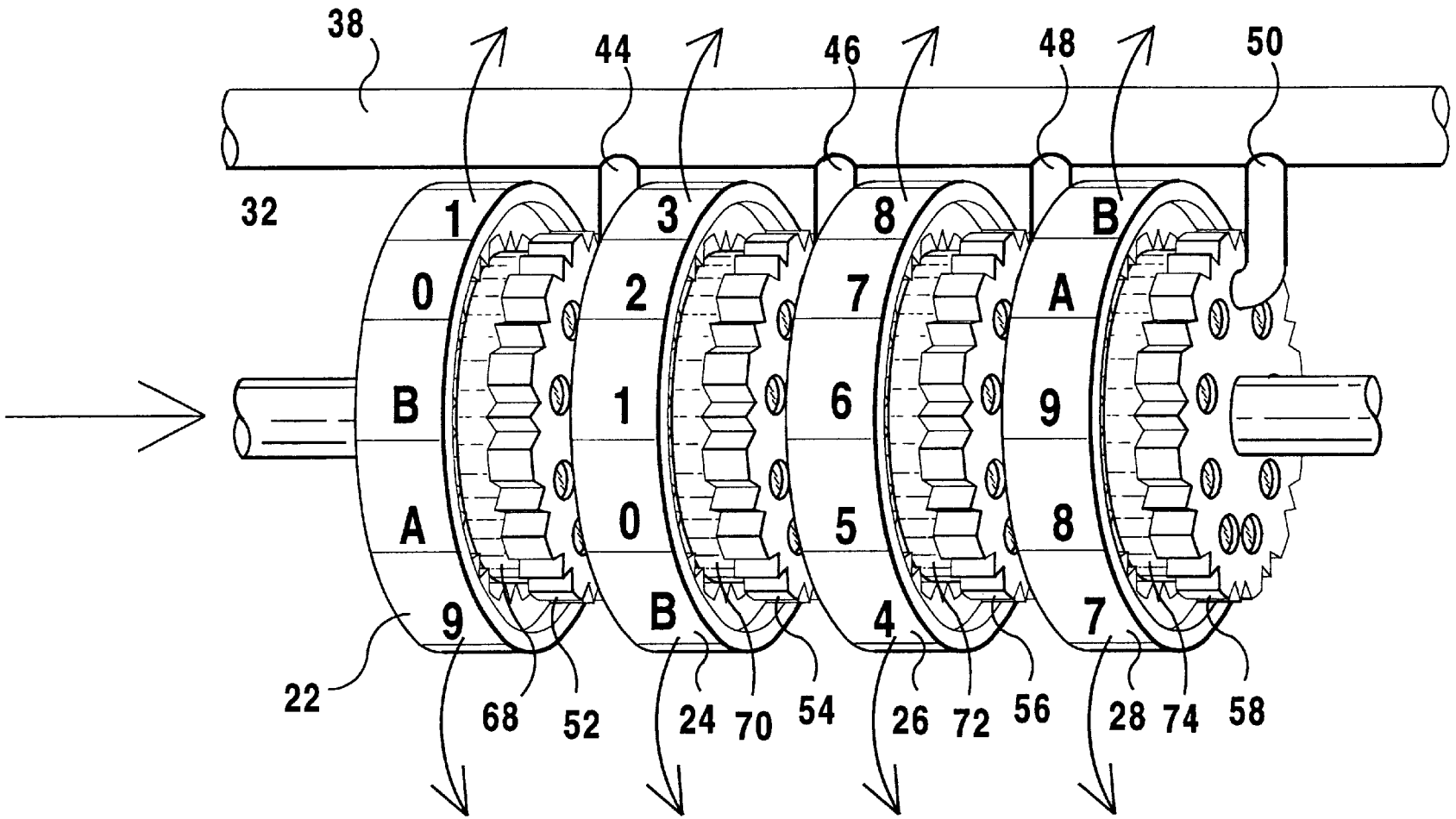
FIG. 6 is a perspective view of the tumblers. Shown is a toothed gear which has been pushed from the center of the tumblers. This allows the outer wheels to be turned to any desired number or letter for each tumbler. When the selection is complete the button located on the front of the weapon will be released whereby the inner gear will return to its seated position.

Turning to FIG. 6, therein is shown a perspective view of the tumblers 22, 24, 26 and 28. Also shown is the toothed gear 52, 54, 56 and 58 which has been pushed from and disengaged from the center of the tumblers 22, 24, 26 and 28 by pushing inwardly on the push button (not shown). This provides means and allows the outer wheels 22, 24, 26 and 28 of the tumblers to be turned to any desired number or letter for each tumbler 22, 24, 26 and 28. When the selection is completed the gear release button 30 located on the front of the weapon will be released whereby the inner gear 52, 54, 56 and 58 will return to its seated position. Also shown is the center tumbler shaft 32 along with the trigger deactuator rod 38 and the tumbler pins 44, 46, 48 and 50. It can be seen that the outer tumblers 22, 24, 26 and 28 are concentrically mounted on the central shaft 32 along with the toothed gears 52, 54, 56 and 58. When the toothed gears 52, 54, 56 and 58 are pushed inwardly along shaft 32 from the center of the tumblers 22, 24, 26 and 28, the tips of the teeth of the tumblers rotably contact and mount on an inner smooth flange 68, 70, 72 and 74 of the toothed gears thereby allowing the tumblers to be turned about the central shaft 32. Note the teeth of gears 52, 54, 56 and 58 are alternately wide and a narrow teeth.

Figure 7:
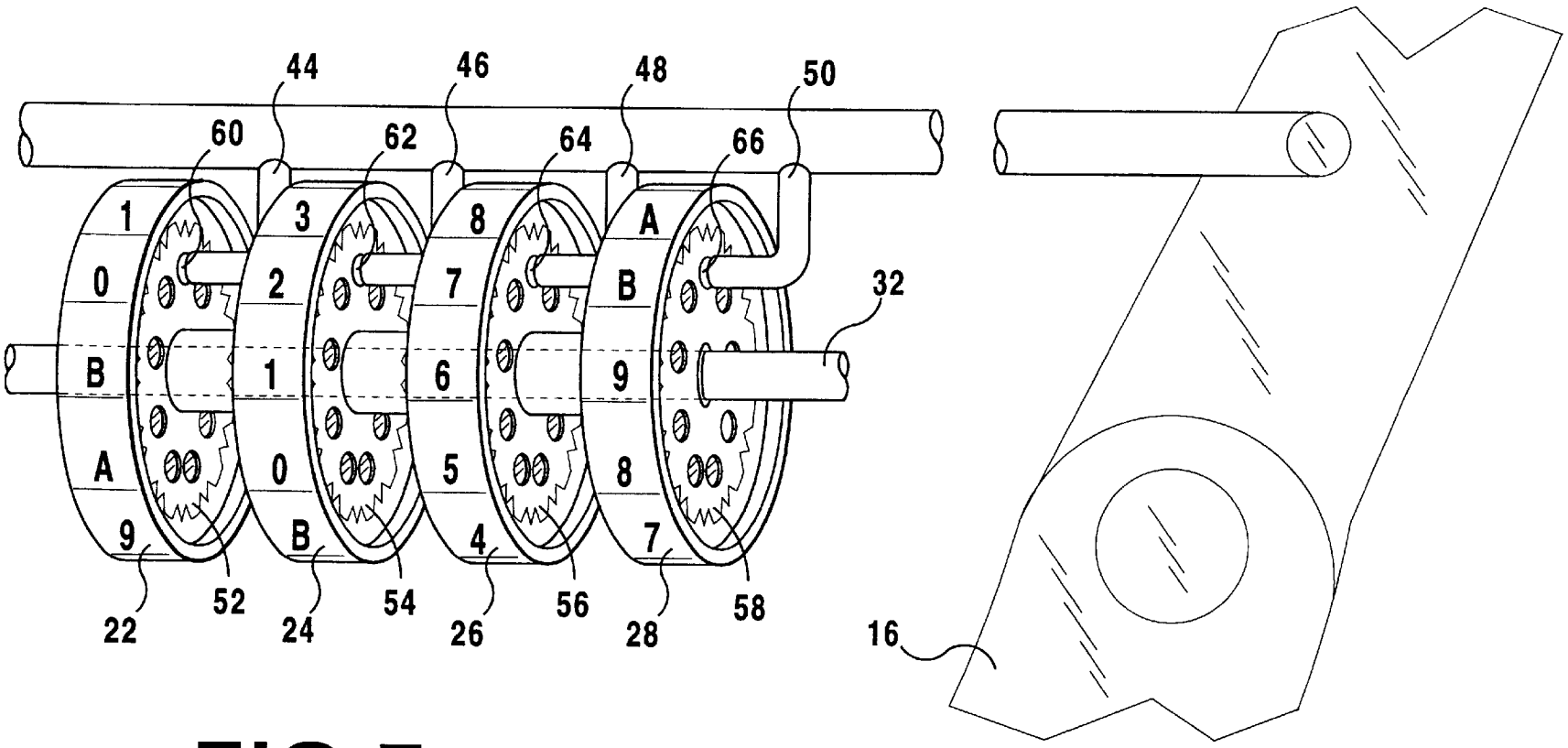
FIG. 7 is a perspective view of the inner gear in the returned position with the new combination.

Turning to FIG. 7, therein is shown a perspective view of the inner gear 52, 54, 56 and 58 in the return position or seated position having had a new combination installed. Also shown are the tumblers 22, 24, 26 and 28, the trigger deactuator rod 38 and the tumbler pins 44, 46, 48 and 50, along with the trigger 16.

Figure 8:
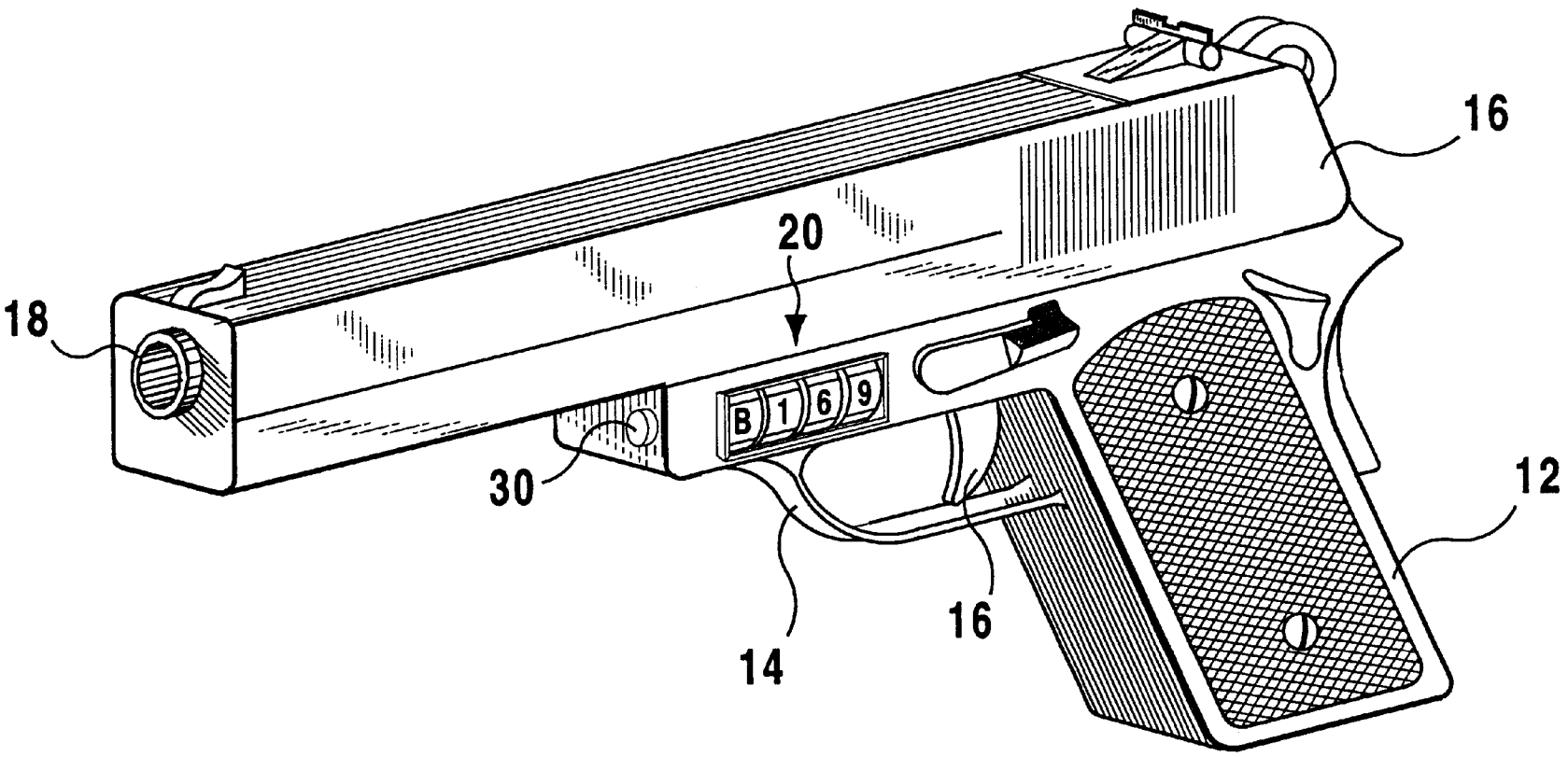
FIG. 8 is a perspective view of the present invention with the new combination installed.

Turning to FIG. 8, therein is shown a perspective view of the present invention 20 with a new combination installed. Also shown therein is the firearm 10, the trigger 16 and the push button release 30.

Figure 9:
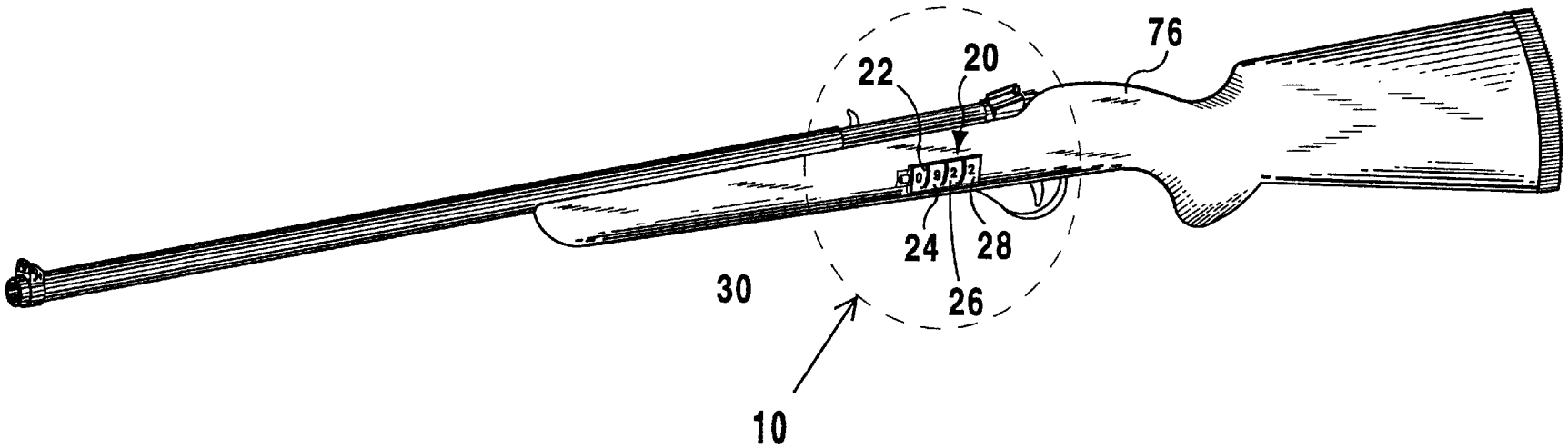
FIG. 9 is a perspective view of the present invention installed in a rifle. Shown is a disk tumbler padlock having a plurality (typically four) disk tumblers, which provides for 10,000 possible various combinations, incorporated into the stock of the rifle.

Turning to FIG. 9, therein is shown a perspective view of the present invention installed in a rifle 76. Also shown is the combination lock assembly 20 having a plurality (typically four) disk tumblers 22, 24, 26 and 28 along with the push button release 30. Note that the tumbler mechanism is similar to the mechanism previously described for a pistol and operates in the same manner and has the same parts.

Figure 10:
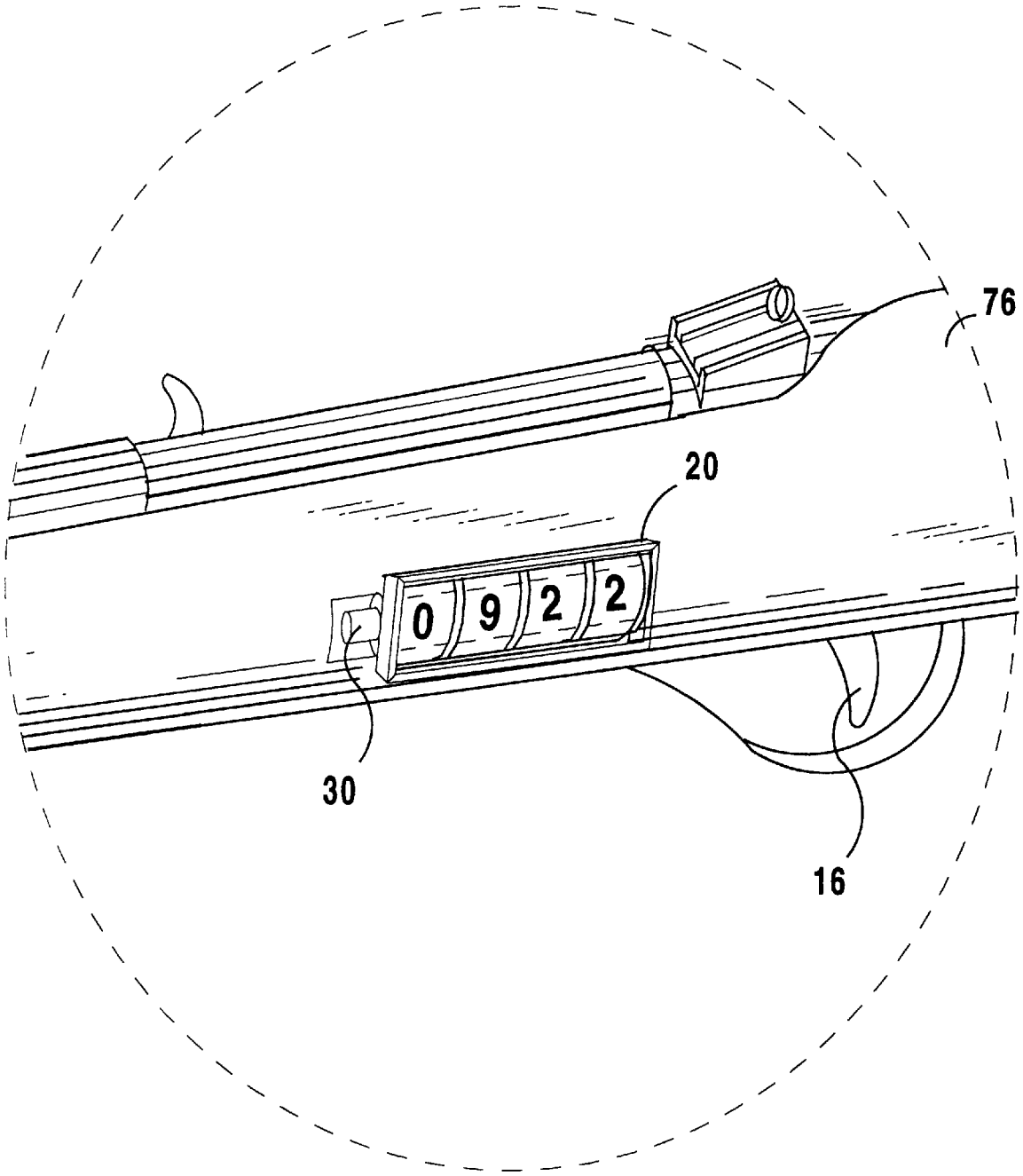
FIG. 10 is an enlarged view of the present invention installed in a rifle, taken from FIG. 6 as indicated. The push button will install through a recess for this particular stock type into the disk tumbler padlock and trigger assembly whereby the authorized user can change the combination or pin number.

Turning to FIG. 10, therein is shown an enlarged view of the present invention installed on a rifle 76, taken from FIG. 6 as indicated. The push button 30 will install into a recess for this particular rifle stock into the disk tumbler lock mechanism 20 and trigger assembly whereby the authorized user can change the combination or pin number.

What is claimed is new and desired to be protected by Letters Patent is set forth in the appended claims.

What is claimed is:

1. A lock for the firing mechanism of a firearm, comprising:

(a) a combination lock;

(b) said combination lock having multiple rotatable disk lock tumblers;

(c) said multiple disk tumblers being adjacent to each other having a central axis mounted on a central shaft;

(d) said multiple disk tumblers each having a multiple central toothed gear located concentrically inside said disk tumbler whereby said disk tumbler communicates with said central toothed gear;

(e) said central toothed gear having a hole therein adjacent said central shaft of said central toothed gear;

(f) said multiple disk tumblers having an outer rotatable casing having numbered areas circumferentially spaced about said disk;

(g) means for selectably rotating said rotable casing for selecting one said numbered area;

(h) means for said selected numbered area on said rotable casing selectively positioning said hole in said central toothed gear about said central shaft whereby said hole corresponds to said selected numbered area of said rotable casing; and, (i) trigger deactivation means having means for communicating with said hole in said central toothed gear whereby the firearm is firable only when said selected numbered area of said outer rotable casing is in the selected position.

2. The apparatus of claim 1, further comprising a plurality of rotable disk lock tumblers.

3. The apparatus of claim 1, further comprising said central toothed gear having multiple holes therein adjacent said central shaft of said central toothed gear.

4. The apparatus of claim 3, wherein said multiple holes comprise a plurality of shallow holes and one through hole.

5. The apparatus of claim 3, wherein said multiple holes comprise eleven shallow holes and one through hole.

6. The apparatus of claim 4, wherein said shallow holes lockably engage said outer rotatable casing whereby said outer rotatable casing is non-rotatable when said trigger deactivation means communicate with said shallow holes.

7. The apparatus of claim 1, wherein said means for selectably rotating said rotable casing for selecting one said numbered area further comprises means for disengaging said inner central toothed gear from said outer rotable casing.

8. The apparatus of claim 7, wherein said means for disengaging said inner central toothed gear from said outer rotable casing comprises a push button mechanism biased outwardly, said push button moving axially inwardly whereby said inner central toothed gear is disengaged from said outer rotable casing.

9. The apparatus of claim 1, wherein said trigger deactivation means comprise a trigger deactuator rod adjacent to and parallel to said central shaft of said disk lock tumblers.

10. The apparatus of claim 9, wherein said trigger deactuator rod further comprises multiple transversely extending tumbler pins, said tumbler pins communicating with said hole of said central toothed gear wherein the firearm can be fired.

* * * * *